US009474944B2

(12) United States Patent
Ashino

(10) Patent No.: US 9,474,944 B2
(45) Date of Patent: Oct. 25, 2016

(54) GOLF CLUB HEAD

(71) Applicant: DUNLOP SPORTS CO. LTD., Kobe-shi, Hyogo (JP)

(72) Inventor: Takeshi Ashino, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 244 days.

(21) Appl. No.: 14/322,247

(22) Filed: Jul. 2, 2014

(65) Prior Publication Data

US 2015/0038256 A1 Feb. 5, 2015

(30) Foreign Application Priority Data

Jul. 31, 2013 (JP) ..... 2013-158965

(51) Int. Cl.
*A63B 53/04* (2015.01)

(52) U.S. Cl.
CPC ..... *A63B 53/04* (2013.01); *A63B 53/0466* (2013.01); *A63B 2053/0454* (2013.01); *A63B 2053/0458* (2013.01); *A63B 2053/0462* (2013.01)

(58) Field of Classification Search
CPC ..... A63B 2053/0458; A63B 2053/0462; A63B 53/0466; A63B 53/04
USPC ..... 473/342, 345, 346, 349
See application file for complete search history.

(56) References Cited

U.S. PATENT DOCUMENTS

| | | | | |
|---|---|---|---|---|
| 8,727,908 | B2 * | 5/2014 | Goto | A63B 53/0466 473/329 |
| 2004/0082404 | A1 * | 4/2004 | Willett | A63B 53/04 473/342 |
| 2005/0192117 | A1 * | 9/2005 | Knuth | A63B 53/0466 473/342 |
| 2010/0255930 | A1 * | 10/2010 | Rice | A63B 53/0466 473/329 |
| 2011/0159987 | A1 * | 6/2011 | Takechi | A63B 53/0466 473/345 |

FOREIGN PATENT DOCUMENTS

JP 2008-036050 A 2/2008

* cited by examiner

*Primary Examiner* — Benjamin Layno
(74) *Attorney, Agent, or Firm* — Birch, Stewart, Kolasch & Birch, LLP

(57) ABSTRACT

A golf club head according to the present invention includes a face portion, a sole portion, and a crown portion. The face portion has a central region, a toe region arranged on the toe side with respect to the central region in the toe-heel direction, and a heel region arranged on the heel side with respect to the central region in the toe-heel direction. The central region is formed with a higher thickness than the toe region and the heel region. The toe region and the heel region have multiple reduced-thickness portions that are arranged at intervals in the toe-heel direction and extend from the sole portion side to the crown portion side.

17 Claims, 5 Drawing Sheets

(a)

(b)

Cross-section along E1

GOLF CLUB HEAD

TECHNICAL FIELD

The present invention relates to a golf club head.

BACKGROUND ART

The heads of wood golf clubs have conventionally undergone many improvements, and in particular, various proposals have been made with respect to the face portion for hitting the ball. Generally, the central region of the face portion is the region that hits the ball most often, and therefore its mechanical strength has been improved by increasing its thickness. On the other hand, the region on the toe side or heel side of the central region has a lower thickness than the central region. With the golf club head disclosed in Patent Literature 1, which is one example of this type of golf club, an X-shaped thick portion is formed in the center of the face portion, and the thickness is reduced in the other regions. Accordingly, even if the impact point shifts from the center of the face portion to the toe side or the heel side, the impact region easily bends due to having a low thickness, and the restitution performance is high. It is therefore possible to suppress a reduction in flight-distance.

CITATION LIST

Patent Literature

Patent Literature 1: JP 2008-36050A

SUMMARY OF INVENTION

Although the restitution performance can be improved by reducing the thickness as described above, there is a problem in that the mechanical strength decreases if the thickness is simply reduced. Accordingly, there is a limit to how much the thickness can be reduced, and it has not been possible to achieve a very low thickness. It has therefore been common to prioritize mechanical strength and sacrifice restitution performance in face portion design. The present invention has been achieved in order to solve the above problems, and an object thereof is to provide a golf club head that can suppress a reduction in mechanical strength while raising the restitution performance on the toe side and the heel side of the face portion.

A golf club head according to the present invention is a golf club head including a face portion, a sole portion, and a crown portion, wherein the face portion has a central region, a toe region arranged on a toe side with respect to the central region in a toe-heel direction, and a heel region arranged on a heel side with respect to the central region in the toe-heel direction, the central region is formed with a higher thickness than the toe region and the heel region, and the toe region and the heel region have a plurality of reduced-thickness portions that are arranged at intervals in the toe-heel direction and extend from the sole portion side to the crown portion side.

In the above golf club head, the plurality of reduced-thickness portions may be formed so as to be band-like.

In the above golf club head, the width of the reduced-thickness portions in the toe-heel direction may be in a range of 1.0 to 10.0 mm, for example.

In the above golf club head, a difference in thickness between the reduced-thickness portions and a region other than the reduced-thickness portions in the toe region and the heel region may be in a range of 0.1 to 0.5 mm, for example.

In the above golf club head, a transitional region whose thickness progressively decreases with increasing distance from the central region may be formed between the central region and the toe region and between the central region and the heel region.

The above golf club head may be configured so as to further include a golf club head body that has the crown portion, the sole portion, and the side portion, and also has an opening surrounded by the crown portion, the sole portion, and the side portion, wherein the face portion may be formed so as to be cup-shaped having an impact portion for hitting a ball and a peripheral portion that extends away from a periphery of the impact portion, and may be arranged so as to block the opening of the golf club head body.

In the above golf club head, in the peripheral portion of the impact portion of the face portion, the thickness of a region adjacent to the toe region may be lower than the thickness of the toe region, and in an interior peripheral portion of the face portion, the thickness of a region adjacent to the heel region may be lower than the thickness of the heel region.

According to the present invention, multiple reduced-thickness portions that extend from the sole portion side to the crown portion side are formed at intervals in the toe-heel direction in the toe region and the heel region of the face portion. The thickness of the toe region and the heel region is therefore reduced on average, thus making it possible to improve the restitution performance. Also, forming the reduced-thickness portions also has an advantage of making it possible to reduce the weight of the face portion.

When a golf ball is hit, the face portion deforms into a recessed shape centered about the point of impact with the ball, and it is known that the plane extending in the up-down direction bends to a large degree in the deformation at this time. In view of this, in the present invention, regions with a high thickness between adjacent reduced-thickness portions are formed so as to extend from the sole portion side to the crown portion side. In other words, since the regions with a high thickness extend so as to correspond to the direction in which deformation occurs, the effect of reinforcement with respect to deformation is improved. Accordingly, even if the reduced-thickness portions are formed in the toe region and the heel region, it is possible to improve the restitution performance without a large reduction in mechanical strength.

REFERENCE SIGNS LIST

1 Face portion

11 Impact portion

Figure 1:
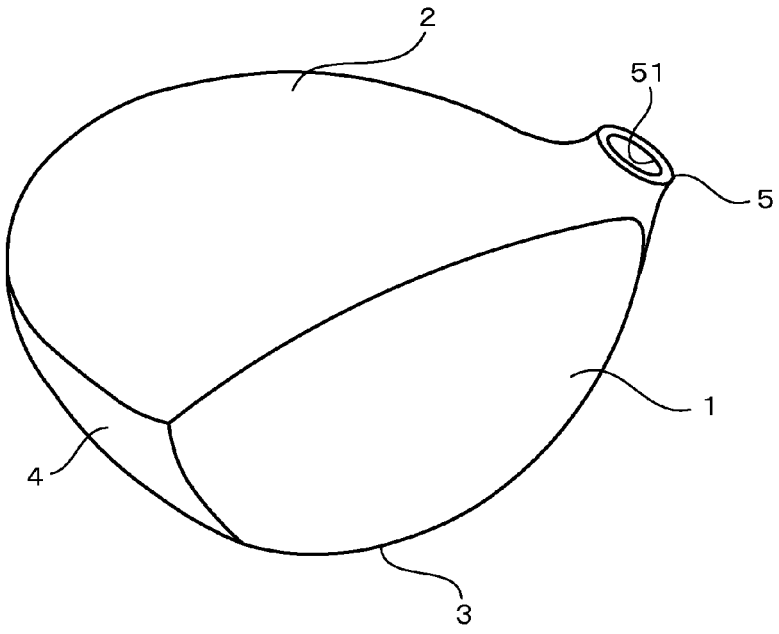
FIG. 1 is a perspective view of a reference state of a golf club head according to an embodiment.

111 Central region
112 Transitional region
113 Toe region
1131 Reduced-thickness portion
114 Heel region
1141 Reduced-thickness portion
12 Peripheral portion
2 Crown portion
3 Sole portion
4 Side portion

DESCRIPTION OF EMBODIMENTS

Figure 2:
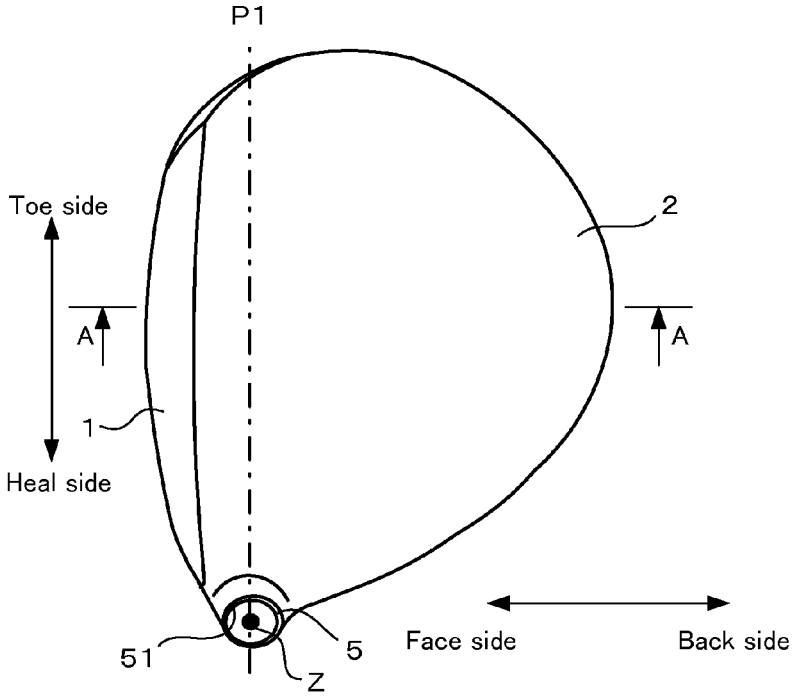
FIG. 2 is a plan view of FIG. 1.

An embodiment of a golf club head according to the present invention will be described below with reference to the drawings. FIG. 1 is a perspective view of a reference state of the golf club head of the present embodiment, and FIG. 2 is a plan view of FIG. 1. Note that the reference state of the golf club head will be described later.

1. Overview of Golf Club Head

As shown in FIG. 1, the golf club head of the present embodiment (hereinafter sometimes simply referred to as the "head") is a hollow structure and has wall surfaces formed by a face portion 1, a crown portion 2, a sole portion 3, a side portion 4, and a hosel portion 5.

The face portion 1 has a face surface, which is the surface for hitting a ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft. Although the head described here is a wood head such as a driver (#1) or fairway wood head, it is not limited to being a wood head, and may be a so-called utility head, hybrid head, or the like.

The following describes the aforementioned reference state. First, as shown in FIGS. 1 and 2, the reference state is defined as a state in which the central axis Z is in a plane P1 that is perpendicular to a horizontal plane H (FIG. 5), and furthermore the head is placed on the horizontal plane H at a predetermined lie angle and real loft angle. The plane P1 will be referred to as the reference vertical plane P1. Also, as shown in FIG. 2, the direction of the line of intersection of the reference vertical plane P1 and the horizontal plane H will be referred to as the toe-heel direction, and the direction that is perpendicular to the toe-heel direction and parallel to the horizontal plane H will be referred to as the face-back direction.

Figure 3:
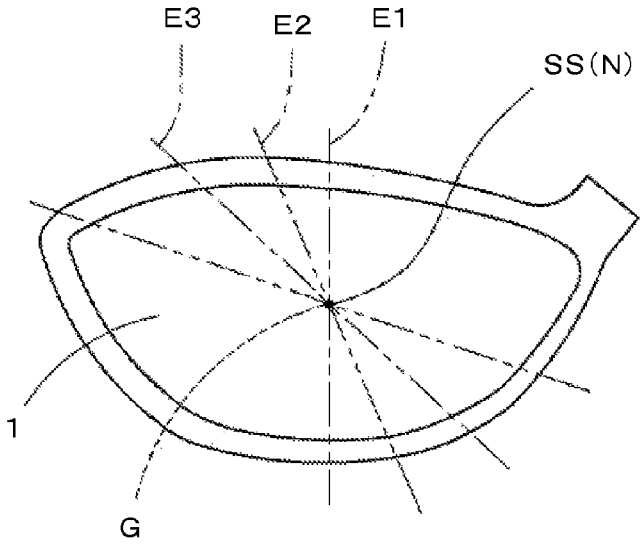
FIGS. 3A and 3B are diagrams illustrating the boundary of a face portion.
Figure 3:
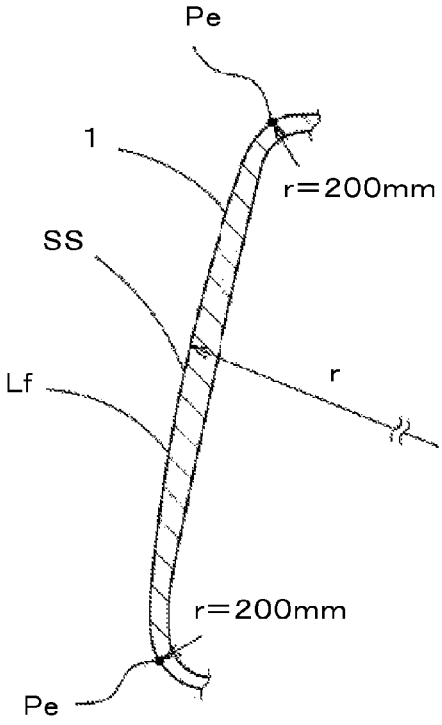

In the present embodiment, the boundary between the crown portion 2 and the side portion 4 can be defined as follows. Specifically, if a ridge line is formed between the crown portion 2 and the side portion 4, that ridge line serves as the boundary. On the other hand, if a clear ridge line is not formed, the boundary is the outline that is seen when the head is placed in the reference state and viewed from directly above the center of gravity of the head. Similarly, in the case of the boundary between the crown portion 2 and the face portion 1 as well, if a ridge line is formed, that ridge line serves as the boundary. However, if a clear ridge line is not formed, the periphery (boundary) of the face portion 1 is defined by positions Pe where, in cross-sections E1, E2, E3, and so on that include a straight line N connecting a head center of gravity G and a sweet spot SS as shown in FIG. 3A, a radius of curvature r of an outline Lf of the outer surface of the face first reaches 200 mm when extending outward from the sweet spot side as shown in FIG. 3B. Note that the sweet spot SS is the point where the normal line (straight line N) of the face surface that passes through the head center of gravity G intersects the face surface.

The volume of this golf club head is, for example, preferably 300 $cm^3$ or more, more preferably 400 $cm^3$ or more, and particularly preferably 420 $cm^3$ or more. Having such a volume is advantageous for the head in terms of increasing comfort when the club is held and also increasing the sweet spot area and the moment of inertia. Note that although an upper limit is not particularly defined for the head volume, practically it is, for example, desirably 500 $cm^3$ or less, or desirably 470 $cm^3$ or less when complying with R&A or USGA rules and regulations.

Also, the head can be formed from a titanium alloy having a specific gravity of approximately 4.4 to 4.5 (Ti-6Al-4V), for example. Besides a titanium alloy, the head can be formed from one or two or more materials selected from among stainless steel, maraging steel, an aluminum alloy, a magnesium alloy, an amorphous alloy, and the like.

Note that the head of the present embodiment is constituted by assembled the face portion 1 to a head body having the crown portion 2, the sole portion 3, and the side portion 4. The head body has an opening surrounded by the crown portion 2, the sole portion 3, and the side portion 4, and the face portion 1 is attached so as to block this opening.

2. Structure of Face Portion

Figure 4:
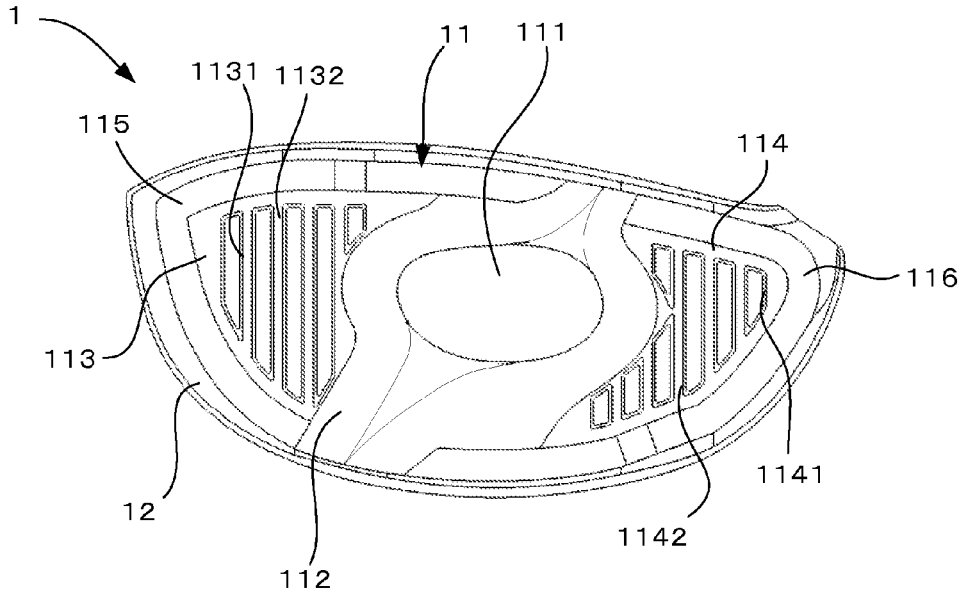
FIG. 4 is a rear view of the face portion of the golf club head shown in FIG. 1.
Figure 5:
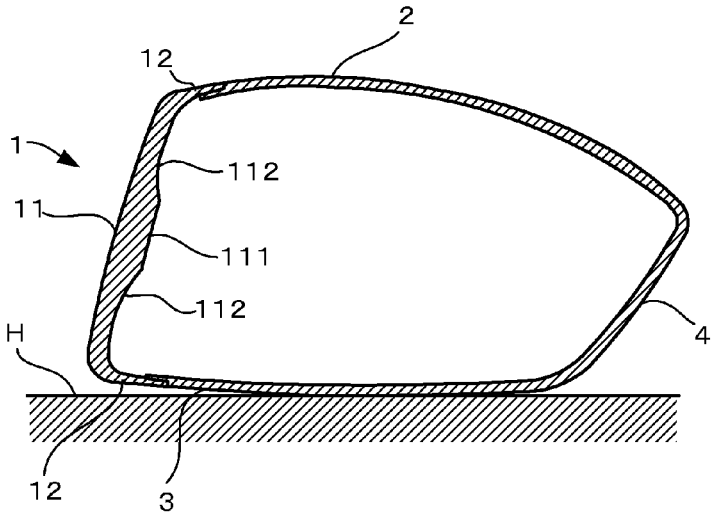
FIG. 5 is a cross-sectional view taken along A-A in FIG. 2.

The following describes the face portion 1 with reference to FIGS. 4 and 5 as well. FIG. 4 is a rear view of the face portion as viewed from the rear face side, and FIG. 5 is a cross-sectional view taken along line A-A in FIG. 2. As shown in FIGS. 4 and 5, the face portion 1 is formed so as to be cup-shaped having an impact portion 11 for hitting balls and a peripheral portion 12 that extends away from the periphery of the impact portion 11, and is attached so as to block the opening of the head body. At this time, the peripheral portion 12 is arranged on the outer periphery of the opening.

Next, the structure of the impact portion 11 of the face portion 1 will be described. As shown in FIG. 5, the face of the impact portion 11 that faces outward is formed so as to be flat, and recessions and protrusions are formed on the face that faces inward. Accordingly, the impact portion 11 is constituted by multiple regions having different thicknesses. As shown in FIG. 4, the impact portion 11 is provided with an elliptical central region 111 in the central area with respect to the up-down direction and the left-right direction (toe-heel direction). Also, a transitional region 112 whose thickness changes is formed so as to surround the central region 111. Furthermore, a toe region 113 and a heel region 114 are formed so as to sandwich the transitional region 112 on the toe side and the heel side respectively. Moreover, a toe-side peripheral region 115 is formed in the peripheral portion of the toe region 113 excluding the portion in contact with the transitional region 112, and a heel-side peripheral region 116 is formed in the peripheral portion of the heel region 114 excluding the portion in contact with the transitional region 112.

Next, features of the various regions will be described. The central region 111 is the region with the highest thickness, and its thickness is preferably 3.0 to 4.2 mm, and more preferably 3.4 to 3.8 mm, for example. Also, the surface area of the central region 111 can be set to 3 to 20 $cm^2$, for example. The transitional region 112 is formed such that its thickness progressively decreases with increasing distance from the central region 111. Also, the periphery of the transitional region 112 with the lowest thickness is in contact with the toe region 113 or the heel region 114. Providing the transitional region 114 in this way prevents the thickness from changing rapidly and prevents a reduction in strength.

The toe region 113 is formed so as to be triangular, and multiple band-like reduced-thickness portions 1131 that extend in the up-down direction are formed inside the toe region 113. The up-down direction is the direction from the sole portion 3 to the crown portion 2, and although it refers to the direction perpendicular to the horizontal plane H when the head is in the above-described reference position in the present embodiment, it will be simply be referred to here as the up-down direction in order to simplify the description. The reduced-thickness portions 1131 are arranged at predetermined intervals in the toe-heel direction. Specifically, the regions between adjacent reduced-thickness portions 1131 are regions with a high thickness (referred to hereinafter as thick portions 1132), and portions with a high thickness and portions with a low thickness are arranged alternatingly in the toe-heel direction in the toe region 113. Also, the upper end and the lower end of each reduced-thickness portion 1131 extend to positions adjacent to the toe-side peripheral region 115, and therefore the length in the up-down direction differs depending on the position at which the reduced-thickness portion 1131 is formed in the toe-heel direction.

It is preferable that the dimensions of the reduced-thickness portions 1131 and the thick portions 1132 are set as described below in view of maintaining mechanical strength and improving restitution performance, which will be described later. The thickness of the reduced-thickness portions 1131 is preferably 1.6 to 2.6 mm, and more preferably 1.8 to 2.4 mm. Also, the thickness of the thick portions 1132 is preferably 1.8 to 2.8 mm, and more preferably 2.0 to 2.6 mm. The difference in thickness between the reduced-thickness portions 1131 and the thick portions 1132 is preferably 0.1 to 0.5 mm, for example. The width of the reduced-thickness portions 1131 in the toe-heel direction is preferably 1.0 to 10.0 mm, and more preferably 2.0 to 7.0 mm. Also, the width of the thick portions 1132 in the toe-heel direction is preferably 0.5 to 7.0 mm, and more preferably 1.0 to 5.0 mm.

Next, the heel region 114 will be described. The heel region 114 is formed so as to be similar to the toe region 113. Specifically, the heel region 114 is formed so as to be triangular, and multiple band-like reduced-thickness portions 1141 that extend in the up-down direction are formed inside the heel region 114. The reduced-thickness portions 1141 are arranged at predetermined intervals in the toe-heel direction, with thick portions 1142 therebetween. Also, similarly to the toe region 113, the upper end and the lower end of each reduced-thickness portion 1141 extend to positions adjacent to the heel-side peripheral region 116, and therefore the length in the up-down direction differs depending on the position at which the reduced-thickness portion 1141 is formed in the toe-heel direction. Note that the thicknesses and widths of these portions are the same as in the toe region, and therefore will not be described here.

Next, the peripheral regions will be described. The toe-side peripheral region 115 is formed so as to be V-shaped, and its thickness is 1.0 to 1.8 mm and lower than the thickness of the toe region 113. The heel-side peripheral region 116 on the other hand is similarly formed so as to be V-shaped, and its thickness is 1.2 to 2.0 mm. This thickness is lower than the thickness of the heel region 114, but higher than the thickness of the toe-side peripheral region 115. Also, the end portions of the transitional region 112 in the up-down direction, that is to say the locations in contact with the peripheral portion 12 of the face portion 1, are thicker than the toe-side peripheral region 115 and the heel-side peripheral region 116. Providing the peripheral regions 115 and 116 in this way makes it possible to promote bending of the face portion 1 and improve the restitution performance. Also, the bending of the peripheral regions 115 and 116 can be performed easily when forming the cup face structure.

Note that the golf club head configured as described above can be created with various methods, and can be manufactured by casting using a known lost-wax precision casting method, for example.

3. Features

The golf club head of the above-described embodiment has features such as the following.

(1) In the present embodiment, multiple reduced-thickness portions 1131 and 1141 that extend in the up-down direction are formed at intervals in the toe-heel direction in the toe region 113 and the heel region 114 of the face portion 1. The thickness of the toe region 113 and the heel region 114 is therefore reduced on average, thus making it possible to improve the restitution performance in these regions.

(2) By forming the reduced-thickness portions 1131 and 1141 in the toe region 113 and the heel region 114, it is possible to reduce the weight of the face portion 1. Also, the amount of weight corresponding to the reduction in thickness for weight reduction can be distributed to other portions of the head. This enables improving the degree of freedom in head design. For example, if the above-described weight is distributed to the sole portion 3 of the club head, the center of gravity can be lowered, consequently making it possible to raise the launch angle. Alternatively, if the weight is distributed to the side portion 4, the moment of inertia about the vertical axis passing through the center of gravity of the head can be increased, thus making it possible to improve directionality when hitting a ball.

(3) When a golf ball is hit, the face portion 1 deforms into a recessed shape centered about the point of impact with the ball, and it is known that particularly the plane extending in the up-down direction bends to a large degree in the deformation at this time. In view of this, in the present embodiment, the thick portions 1132 and 1142 are formed so as to extend in the up-down direction between adjacent reduced-thickness portions 1131 and 1141. In other words, since the thick portions 1132 and 1142 extend so as to correspond to the direction in which deformation occurs, the effect of reinforcement with respect to deformation is improved. Accordingly, even if the reduced-thickness portions 1131 and 1141 are formed in the toe region 113 and the heel region 114, it is possible to improve the restitution performance without a large reduction in mechanical strength.

4. Variations

Although an embodiment of the present invention has been described above, the present invention is not limited to the above embodiment, and various modifications can be carried out without departing from the gist of the invention. The following are examples of modifications.

Although the face portion 1 has a so-called cup face structure in the above embodiment, it is possible to omit the peripheral portion 12 such that the face portion 1 is constituted by only the impact portion 11.

Although the reduced-thickness portions 1131 and 1141 of the toe region 113 and the heel region 114 are formed so as to extend in the up-down direction in the above embodiment, they do not need be formed strictly in the up-down direction. In other words, they need only extend from the sole portion 3 toward the crown portion 2 so as to correspond to the deformation behavior described above. A slight inclination from the above-described up-down direction is therefore permissible.

Also, the reduced-thickness portions 1131 and 1141 do not need to be band-like, and may be linear or curved as long as they extend from the sole portion 3 toward the crown portion 4. Also, there are no particular limitations on the number and widths of the reduced-thickness portions 1131 and 1141.

Although the transitional region 112 and the peripheral portions 115 and 116 are provided in the above embodiment, they do not need to be provided. In other words, the present invention need only have at least three regions, namely the central region 111, the toe region 113, and the heel region 114. Also, there are no particular limitations on their shapes, and for example, the central region 111 is not necessarily required to be elliptical, and can have various shapes such as circular or rectangular. Also, the toe region 113 and the heel region 114 need only be present in a region extending from the two sides of the central region 111 to the peripheral edge, and there are no particular limitations on the shapes of the toe region 113 and the heel region 114 as long as the reduced-thickness portions 1131 and 1141 are formed.

Although the head of the above embodiment is constituted by combining the head body and the face portion 1, the present invention is also applicable to a head in which the crown portion 2 and other portions are formed separately, for example.

Working Example

The following describes a working example of the present invention. Note that the present invention is not limited to the following working example.

(1) Preparation of Working Example and Comparative Example

Figure 6:
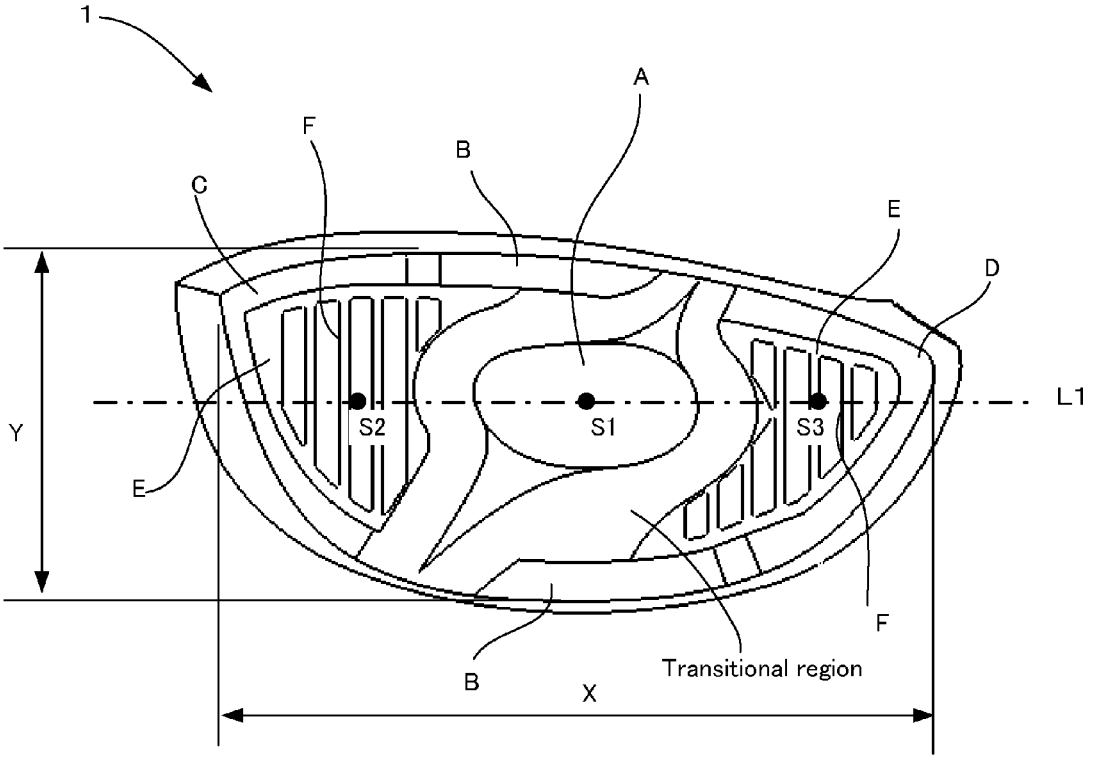
FIG. 6 is a rear view of a face portion according to a working example.
Figure 7:
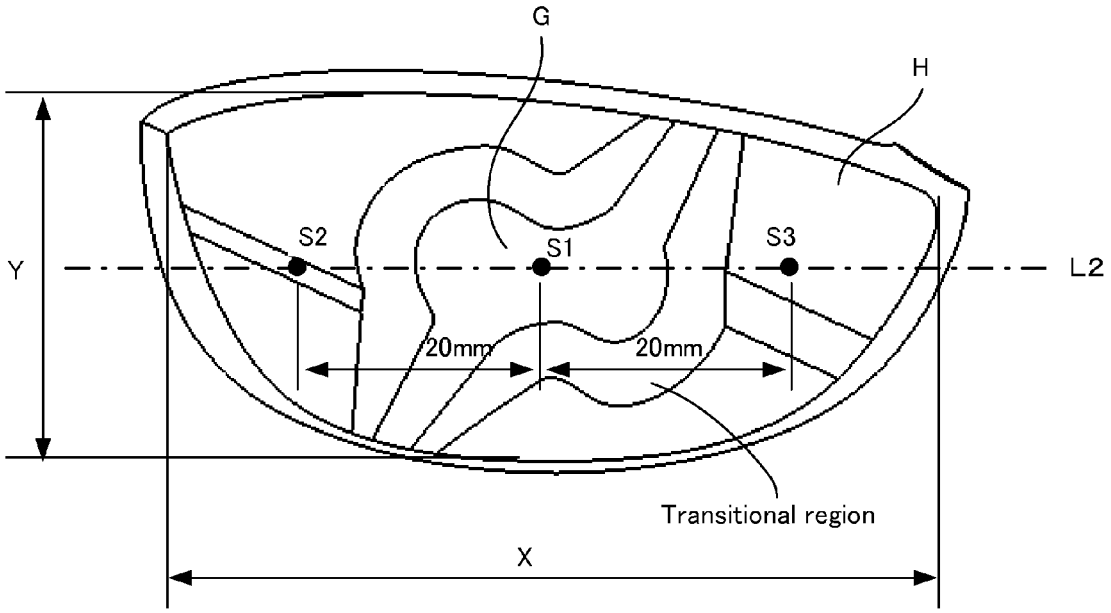
FIG. 7 is a rear view of a face portion according to a comparative example.

Golf club heads (drivers (#1)) pertaining to a working example and a comparative example having different face portion configurations were created, and a restitution performance test and a durability test, which will be described later, were carried out. Aspects of the face portion of the working example are shown in FIG. 6, and aspects of the face portion of the comparative example are shown in FIG. 7. The working example and the comparative example were the same as each other with the exception of the structure of the rear face of the face portion. Specifically, each head had a two-piece structure formed by Tig-welding a cup-shaped face portion constituted by a hot-forged piece made of Ti-6Al-4V to a head body constituted by a lost-wax precision casted piece made of Ti-6Al-4V. Also, the head volume was 460 $cm^3$, the total surface area of the rear face of the face portion was 42.0 $cm^2$, and the head mass was 194 g. Furthermore, a width X1 in the toe-heel direction of the face portion of the working example and the comparative example was 108 mm, and a height Y1 in the up-down direction was 50 mm (region excluding the peripheral portion).

The thicknesses of the various regions of the face portion in the working example are shown in Table 1, and those in the comparative example are shown in Table 2.

TABLE 1

| Region | Thickness (mm) |
|---|---|
| A (central region) | 3.65 |
| B | 2.15 |
| C (toe-side peripheral region) | 1.25 |
| D (heel-side peripheral region) | 1.55 |

TABLE 1-continued

| Region | Thickness (mm) |
|---|---|
| E (toe region, heel region) | 2.15 |
| F (reduced-thickness portion) | 1.95 |

Also, the width of the reduced-thickness portions of the toe region and the heel region was 3.0 mm, and the interval between reduced-thickness portions was 2.0 mm.

TABLE 2

| Region | Thickness (mm) |
|---|---|
| G (central region) | 3.65 |
| H | 2.0 |

Note that although the thickness of the transitional region is not shown in the above tables, the width progressively changed between the regions that sandwich the transitional region. For example, the transitional region of the working example is formed between the region A and the region E, and therefore the thickness changed from 3.65 mm to 2.15 mm from the region A toward the region E.

(2) Restitution Performance Test

The coefficient of restitution was obtained in accordance with the U.S.G.A. Procedure for Measuring the Velocity Ratio of a Club Head for Conformance to Rule 4-1e, Revision 2 (Feb. 8, 1999). Measurement was performed at measurement positions on straight lines L1 and L2 extending in the toe-heel direction shown in FIGS. 6 and 7, and Table 3 shows the coefficients of restitution obtained at these positions. According to these results, the coefficient of restitution is substantially the same in the central regions of the working example and the comparative example since they have the same thickness. However, the coefficient of restitution is higher in the toe region and the heel region of the working example. This is thought to be due to the reduction in thickness achieved by forming the reduced-thickness portions.

TABLE 3

| | Center (S1) | Toe 20 mm (S2) | Heel 20 mm (S3) |
|---|---|---|---|
| Working ex. | 0.82 | 0.76 | 0.76 |
| Comparative ex. | 0.82 | 0.74 | 0.74 |

(3) Durability Test

The heads of the working example and the comparative example were mounted to carbon shafts made by Dunlop Sports Co., Ltd. (SV-3003J, Flex X) to create trial 45-inch wood clubs. These clubs were attached to a swing robot made by Miyamae Co., Ltd. and swung with a head speed of 54 m/s so as to hit golf balls with the sweet spot of the face portion, and the number of hits until the head became damaged was counted. The presence or absence of damage was checked by interrupting the hitting after every 10 balls and observing the head with the naked eye. The results were that the face portion of the working example became damaged at 12,000 hits, and the face portion of the comparative example became damaged at 11,000 hits. Accordingly, regardless of the fact that the reduced-thickness portions were formed in the toe region and the heel region of the working example, there was almost no change in durability compared to the comparative example in which the reduced-thickness portions were not provided.

The invention claimed is:

1. A golf club head comprising:

a face portion, a sole portion, and a crown portion, wherein the face portion has a central region, a toe region arranged on a toe side with respect to the central region in a toe-heel direction, and a heel region arranged on a heel side with respect to the central region in the toe-heel direction, the central region is formed with a higher thickness than the toe region and the heel region, and the toe region and the heel region have a plurality of reduced-thickness portions that are arranged at intervals in the toe-heel direction and extend from the sole portion side to the crown portion side and have a plurality of thickness portions that are formed between adjacent reduced-thickness portions, and the width of each thickness portion in the toe-heel direction is 0.5 to 7.0 mm.

2. The golf club head according to claim 1, wherein the plurality of reduced-thickness portions are formed so as to be band-like.

3. The golf club head according to claim 2, wherein the width of the reduced-thickness portions in the toe-heel direction is in a range of 1.0 to 10.0 mm.

4. The golf club head according to claim 1, wherein a difference in thickness between the reduced-thickness portions and a region other than the reduced-thickness portions in the toe region and the heel region is in a range of 0.1 to 0.5 mm.

5. The golf club head according to claim 1, wherein a transitional region whose thickness progressively decreases with increasing distance from the central region is formed between the central region and the toe region and between the central region and the heel region.

6. The golf club head according to claim 5, wherein the periphery of the transitional region with the lowest thickness is in contact with the toe region or the heel region.

7. The golf club head according to claim 1, further comprising a golf club head body that has the crown portion, the sole portion, and a side portion, and also has an opening surrounded by the crown portion, the sole portion, and the side portion, wherein the face portion is formed so as to be cup-shaped having an impact portion for hitting a ball and a peripheral portion that extends away from a periphery of the impact portion, and is arranged so as to block the opening of the golf club head body.

8. The golf club head according to claim 7, wherein in the peripheral portion of the impact portion of the face portion, the thickness of a region adjacent to the toe region is lower than the thickness of the toe region, and in an interior peripheral portion of the face portion, the thickness of a region adjacent to the heel region is lower than the thickness of the heel region.

9. The golf club head according to claim 1, wherein the thickness of the central region is 3.0 to 4.2 mm.

10. The golf club head according to claim 1, wherein the surface area of the central region is 3 to 20 $cm^2$.

11. The golf club head according to claim 1, wherein a toe-side peripheral region is formed in the peripheral portion of the toe region, and the upper end and the lower end of each reduced-thickness portion in the toe region extend to positions adjacent to the toe-side peripheral region.

12. The golf club head according to claim 1, wherein the thickness of each reduced-thickness portion is 1.6 to 2.6 mm.

13. The golf club head according to claim 1, wherein thickness portions are formed between adjacent reduced-thickness portions, and the thickness of each thick portion is 1.8 to 2.8 mm.

14. The golf club head according to claim 1, wherein the width of each reduced-thickness portion in the toe-heel direction is 1.0 to 10.0 mm.

15. The golf club head according to claim 1, wherein a heel-side peripheral region is formed in the peripheral portion of the heel region, and the upper end and the lower end of each reduced-thickness portion in the heel region extend to positions adjacent to the heel-side peripheral region.

16. The golf club head according to claim 1, wherein the thicknesses and the widths in the toe-heel direction of each reduced-thickness portion in the toe region are the same as those of each reduced-thickness portion in the heel region.

17. A golf club head comprising:

a face portion, a sole portion, and a crown portion, wherein the face portion has a central region, a toe region arranged on a toe side with respect to the central region in a toe-heel direction, and a heel region arranged on a heel side with respect to the central region in the toe-heel direction, the central region is formed with a higher thickness than the toe region and the heel region, the toe region and the heel region have a plurality of reduced-thickness portions that are arranged at intervals in the toe-heel direction and extend from the sole portion side to the crown portion side, and a toe-side peripheral region is formed in the peripheral portion of the toe region, a heel-side peripheral region is formed in the peripheral portion of the heel region, and the thickness of the heel-side peripheral region is greater than that of the toe-side peripheral region.

* * * * *